US007923191B2

(12) United States Patent
Bertelsen et al.

(10) Patent No.: US 7,923,191 B2
(45) Date of Patent: Apr. 12, 2011

(54) POLYESTER RESIN TONER PRODUCED BY EMULSION AGGREGATION

(75) Inventors: Craig Michael Bertelsen, Union, KY (US); Ligia Aura Bejat, Versailles, KY (US); Michael James Bensing, Lexington, KY (US); John Joseph Kraseski, Lexington, KY (US); Matthew T. Martinkovic, Lexington, KY (US); Jing X. Sun, Lexington, KY (US)

(73) Assignee: Lexmark International, Inc., Lexington, KY (US)

( * ) Notice: Subject to any disclaimer, the term of this patent is extended or adjusted under 35 U.S.C. 154(b) by 896 days.

(21) Appl. No.: 11/828,453

(22) Filed: Jul. 26, 2007

(65) Prior Publication Data

US 2009/0029282 A1 Jan. 29, 2009

(51) Int. Cl.
*G03G 5/00* (2006.01)

(52) U.S. Cl. ..... 430/137.14; 430/137.1; 430/137.5

(58) Field of Classification Search ..... 430/137.14, 430/137.1, 137.5
See application file for complete search history.

(56) References Cited

U.S. PATENT DOCUMENTS

| | | | | |
|---|---|---|---|---|
| 3,980,602 | A | 9/1976 | Jakubauskas | |
| 4,782,109 | A | 11/1988 | DuLaney et al. | |
| 4,983,488 | A | 1/1991 | Tan et al. | |
| 5,945,245 | A | 8/1999 | Mychajlowskij et al. | |
| 6,248,494 | B1 | 6/2001 | Yamazaki et al. | |
| 6,268,103 | B1 | 7/2001 | Hopper et al. | |
| 6,395,445 | B1 | 5/2002 | Toth et al. | |
| 6,463,253 | B2 | 10/2002 | Sato | |
| 6,531,254 | B1 | 3/2003 | Bedells et al. | |
| 6,531,256 | B1 | 3/2003 | Bedells et al. | |
| 6,991,884 | B2 | 1/2006 | Sun et al. | |
| 2007/0013746 | A1 | 1/2007 | Sun | |
| 2007/0054210 | A1* | 3/2007 | Ohki et al. | 430/108.21 |
| 2007/0141506 | A1 | 6/2007 | Inoue et al. | |
| 2008/0014521 | A1 | 1/2008 | Tsubaki et al. | |

* cited by examiner

*Primary Examiner* — Thorl Chea

(57) ABSTRACT

The present disclosure relates to chemically processed toner. The toner may be prepared by an emulsion aggregation method by forming a polyester dispersion wherein the polyester has an acid value of about 5 to about 50 and a particle size of about 50 to about 500 nanometers. The polyester dispersion may then be combined with a pigment and/or release agent dispersion wherein the pigment and/or release agent dispersion may contain a dispersant. This may then be followed by heating and recovering agglomerated toner particles wherein the toner particles may have a mean particle size of about 3 to about 15 microns and an average degree of circularity of between about 0.90 to about 1.0.

20 Claims, No Drawings

POLYESTER RESIN TONER PRODUCED BY EMULSION AGGREGATION

REFERENCE TO RELATED APPLICATIONS

None.

STATEMENT REGARDING FEDERALLY SPONSORED RESEARCH OR DEVELOPMENT

None.

REFERENCE TO SEQUENTIAL LISTING, ETC.

None.

BACKGROUND

1. Field of the Invention

The present invention relates to chemically prepared toner compositions and associated methods for making toners which may be used in electrophotographic printer applications.

2. Description of the Related Art

Toner particles may be formed by the process of compounding a polymeric resin, with colorants and optionally other additives. These ingredients may be blended through, for example, melt mixing. The resultant materials may then be ground and classified by size to form a powder. Toner particulate compositions may also be formed by chemical methods in which the toner particles are prepared by chemical processes such as suspension polymerization or emulsion aggregation rather than being abraded from larger sized materials by physical processes. Toner compositions so formed may be used in electrophotographic printers and copiers, such as laser printers wherein an image may be formed via use of a latent electrostatic image which is then developed to form a visible image on a drum which may then be transferred onto a suitable substrate.

SUMMARY OF THE INVENTION

The present disclosure relates in one exemplary embodiment to a method of forming a chemically processed toner. The method includes forming a polyester dispersion wherein the polyester has an acid value of about 5 to about 50 and a particle size of about 50 to about 800 nanometers by combining the polyester in an organic solvent that is at least partly miscible with water and introducing water and removing substantially all of the organic solvent wherein the dispersion has a pH of about 6 to about 8. One may also form a pigment dispersion in the presence of a dispersant wherein the dispersant contains a hydrophilic component and a hydrophobic component wherein the weight percent of pigment (P) divided by the weight percent of dispersant (D) provides a ratio P/D equal to about 1:1 to about 8:1 and wherein the pigment has a particle size of about 50 to about 800 nanometers. One may also form a release agent dispersion in the presence of a dispersant wherein the dispersant again contains a hydrophilic component and a hydrophobic component wherein the weight percent of release agent (RA) divided by the weight percent of dispersant (D) provides a ratio RA/D equal to about 1:1 to about 15:1 and wherein the release agent has a particle size of about 50 to about 800 nanometers. One may then combine the polyester dispersion and the pigment and the release agent dispersion and agglomerate in the presence of agglomerating agent, along with heating and recovering agglomerated toner particles wherein the toner particles may have mean particle size of about 3 to about 15 microns and an average degree of circularity of between about 0.90 to about 1.0.

In another exemplary embodiment the present disclosure again relates to method of forming a chemically processed toner comprising. The method includes forming a polyester dispersion wherein the polyester again has an acid value of about 5 to about 50, a peak MW as determined by gel permeation chromatography of about 2500 to about 40,000, a molecular weight distribution of about 2 to about 30 and a particle size of about 50 to about 800 nanometers by combining the polyester in an organic solvent that is miscible with water and introducing water and removing substantially all of the organic solvent wherein said dispersion has a pH of about 6 to about 8. One may then form a pigment dispersion in the presence of a dispersant wherein the dispersant contains a hydrophilic component and a hydrophobic component and indicates the onset of a glass transition temperature of about 40 to about 130° C. and wherein the weight percent of pigment (P) divided by the weight percent of dispersant (D) provides a ratio P/D equal to about 1:1 to about 8:1 and wherein the pigment has a particle size of about 50 to about 800 nanometers. One may also form a release agent dispersion in the presence of a dispersant wherein the dispersant contains a hydrophilic component and a hydrophobic component and indicates the onset of a glass transition temperature of about 40 to about 130° C. wherein the weight percent of release agent (RA) divided by the weight percent of dispersant (D) provides a ratio RA/D equal to about 1:1 to about 15:1 and wherein the release agent has a particle size of about 50 to about 800 nanometers. The polyester dispersion and pigment and release agent dispersions may then be combined followed by agglomerating in the presence of agglomerating agent, heating and recovering agglomerated toner particles wherein the toner particles have mean particle size of about 3 to about 15 microns and an average degree of circularity of between about 0.90 to about 1.0.

DETAILED DESCRIPTION

It is to be understood that the invention is not limited in its application to the details of construction and the arrangement of components set forth in the following description or illustrated in the drawings. The invention is capable of other embodiments and of being practiced or of being carried out in various ways. Also, it is to be understood that the phraseology and terminology used herein is for the purpose of description and should not be regarded as limiting. The use of "including," "comprising," or "having" and variations thereof herein is meant to encompass the items listed thereafter and equivalents thereof as well as additional items.

The present disclosure relates to toner and a method of providing a polyester based toner through an emulsion aggregation method. The emulsion aggregation (EA) method may be generally understood as a method wherein the size of the toner particles is provided by chemical methods, as opposed to physical methods such as pulverization. The method may begin with the formation of an emulsion of polymer (polyester) resin particles in water, optionally with organic solvent. Such polyester dispersion may therefore be free of dispersant. A colorant dispersion and release agent dispersion may then be prepared, e.g., a pigment or release agent dispersed in water. Similarly, a dispersion of a charge control agent (CCA) may also be separately formed, wherein a CCA may be understood as a compound that may then assist in the production and stability of a tribocharge in the toner. The colorant, release agent and CCA dispersion may rely upon the use of a dispersant, as explained more fully below.

The colorant dispersion and/or CCA dispersion may then be added to the polyester dispersion, and an aggregating or agglomerating agent may then be added to form aggregated toner particles. The agglomerating agent may include any agent that may promote aggregation. For example, this may include the addition of acid or a proton source (supplying proton neutralization) or it may include the introduction of multivalent metal counter ions (e.g. aluminum, iron or zinc) which may also complex and facilitate aggregation. The aggregated toner particles may then be heated to enable coalescence/fusing (e.g. at a temperature above the glass transition temperature of the polyester) thereby achieving aggregated and fused toner particles. The toner particles produced may have a mean particle size (diameter) of about 3 to about 15 μm and an average degree of circularity between 0.90 to about 1.0, including all values and increments therein. For example, the particles may have a mean size of about 4 to about 10 μm and an average degree of circularity of greater than about 0.93. By way of further example, the particles may have an average degree of circularity of about 0.93 to about 0.96. The average degree of circularity and mean particle size may be provided by a Sysmex Flow Particle Image Analyzer (e.g. FPIA-2100) available from Malvern Instruments.

The various components for the emulsion aggregation method to prepare the above referenced polyester toner will be described below. It should be noted that the various features of the indicated components may all be adjusted to facilitate the step of aggregation and formation of toner particles of desired size and geometry. It may therefore be appreciated that by controlling the indicated characteristics, one may first form relatively stable dispersions, wherein aggregation may proceed along with relatively easy control of final toner particle size for use in an electrophotographic printer or printer cartridge.

The polyester component herein may therefore be understood as including those polyesters which have an acid value of about 5 to about 50, including all values and increments therein. Such acid value may be due to the presence of one or a plurality of free carboxylic acid functionalities (—COOH) in the polyester. For example, acid values of about 10-40, or about 20-30, etc. An acid value is reference to the mass of potassium hydroxide (KOH) in milligrams that is required to neutralize one gram of the polyester. The acid value is therefore a measure of the amount of carboxylic acid groups in the polyester. Reference to an acid value as having a value of about 5 to about 50 may also be understood as reference to an acid value that may vary by about +/−0.50 individual acid value units.

The polyester herein may also be characterized as those polyesters that have a glass transition temperature (Tg) as measured by differential scanning calorimetry (DSC), wherein the onset of the shift in baseline (heat capacity) thereby indicates that the Tg may occur at about 40-80° C. at a heating rate of about 5° C. per minute (e.g. 4.75° C. per minute to 5.25° C. per minute). The midpoint value of the Tg may therefore occur at a slightly higher temperature, at about 43-83° C., including all values and increments therein. Reference to a Tg value of, e.g., about 40 to about 80° C. (onset) may also be understood to include all values and increments therein as well as a variation in the observed individual Tg value of +/−1.5° C.

The polyesters herein may include those polyesters that have a peak MW (Mp) as determined by gel permeation chromatography (GPC) of about 2,500 to about 40,000 as well as all values and increments therein. For example, the value of Mp may be about 4,000-25,000, at +/−500 units. In addition, the polyesters suitable for use herein may be characterized by their molecular weight distribution (MWD) value, or weight average molecular weight (Mw) divided by the number average molecular weight (Mn). Accordingly, the polyesters herein may have a MWD of about 2 to about 30, including all values and increments therein, wherein a given MWD value may be understood to vary +/−0.50. Accordingly, the MWD may have a value of about 3 to about 25, or 4 to about 20, etc.

The polyesters herein may therefore include those which may be characterized as having one or all of the characteristics noted above, and therefore may include linear and/or branched aliphatic and/or aromatic polyesters having the following general formulas:

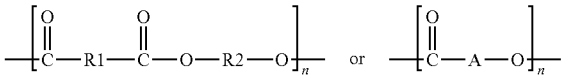

wherein R1 and/or R2 and A may be an aliphatic, aliphatic-aromatic or wholly aromatic group and n may have a value the provides a Mp value of about 2,500-40,000 as noted above. In addition, R1 and/or R2 and A may include a branch, which branching may be selected so as to provide a desired Tg value. By way of further example, the polyester herein may be formed from monomers such as terephthalic anhydride, trimellictic anhydride, 2-dodecen-1yl-succinic anhydride, ethoxylated or propoxylated bisphenol A which may then provide the following random copolymer structural units in the polyester chain:

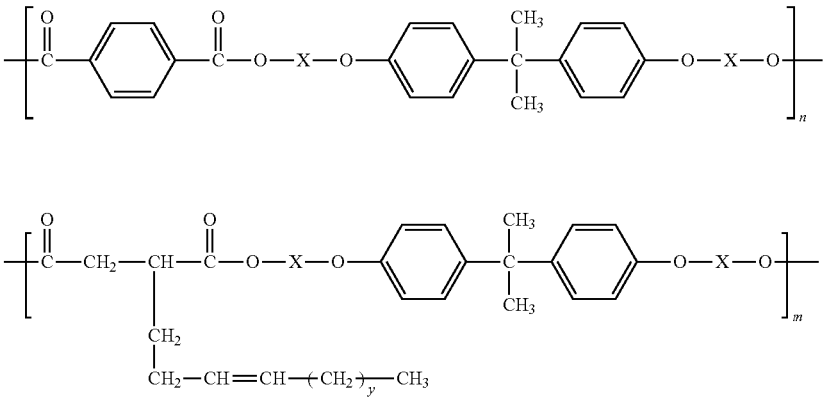

-continued

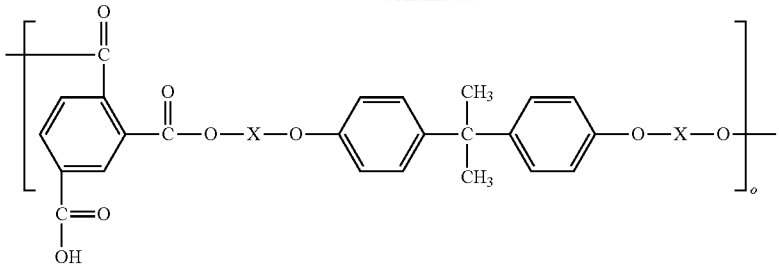

wherein n, m and o are integers which may again provide a Mp value of about 2,500 to 40,000, X is an aliphatic moiety which may then provide groups such as an ethyl ($—CH_2CH_2—$) or propyl ($—CH_2—CH_2—CH_2—$) group, and y may be an integer having a value of 1-20 including all values and increments therein. For example, y may have a value of 8 which would be the result of forming the above polyester from 2-dodeceny-1-yl succinic anhydride in the presence of terephthalic anhydride, trimellitic anhydride and ethoxylated or propoxylated bisphenol A. In addition, as noted above, it may be appreciated that the indicated aliphatic branch may contain residual unsaturation.

The polyester resins employed herein may be polyester resins such as NE701, NE2141, STPL-1, STPL-8 or FPESL-2, all available from Kao Chemical Incorporated. Table 1 below provides the reported characteristics of these exemplary resins.

TABLE 1

| Resin | Tg ° C. (Onset/Midpoint) | Mp | MWD | Acid Value |
|---|---|---|---|---|
| NE701 | 56/59 | 13000 | 20 | 13 |
| NE2141 | 58/61 | 12000 | 5.3 | 23 |
| STPL-1 | 58/62 | 12000 | 13.5 | 25.6 |
| STPL-8 | 56/60 | 5800 | 24 | 25.2 |
| FPESL-2 | 63/67 | 12400 | 3 | 23.4 |

Dispersions of the above indicated polyesters may be generally prepared by dispersing the polyester in a liquid medium, wherein the polyester may be at a particle size of about 50-500 nanometers (nm), including all values and increments therein. For example, the polyester particles in the polyester dispersion may be 50-250 nm, or 75-200 nm, or 100-200 nm, etc. The polyester may then be first mixed in an organic solvent, which organic solvent may indicate some partial miscibility with water and which solvent may be relatively easily removed by evaporation when combined with water (e.g. at temperatures of less than 100° C. and pressures less than 760 mm Hg). The polyester may therefore be combined with such solvents at up to about 50% solids by weight, including all values and increments therein. For example, the polyester may be present at about 25-35% by weight. The organic solvents may therefore include alcohols, ketones (e.g. methyl ethyl ketone), amide solvents (e.g. formamide, N,N-dimethylformamide, N-methylpyrrolidone, 2-pyrrolidone), cyclic ethers (e.g. tetrahydrofuran), ethyl acetate, sulfone solvents (e.g. dimethyl sulfoxide (DMSO)) and mixtures thereof. Once mixed in the above referenced solvents, the mixture may be combined with an equal amount of water wherein the water may contain a base and mixed in high sheer mixer. Such base may include an inorganic base such as potassium or sodium hydroxide, wherein the amount of base is selected so that the pH of the solution is adjusted to about 6 to about 8. At this point, substantially all of the organic solvent may be removed by evaporation. Accordingly, it may be understood that about 95% by weight or more of the organic solvent may be removed. The formed emulsion may also undergo microfluidization if additional reduction in particle size is desired. In addition, as noted above, the polyester dispersions herein may be free of added dispersant.

A dispersion of colorant may be separately prepared. Such colorant may be sourced from a variety of pigments and/or dyes, and reference to pigment herein may be understood to therefore include either a dye (which may be soluble in a given medium and capable of precipitation) or pigment (which may be insoluble in a given medium). The pigment dispersion may therefore be prepared by mixing the pigment in water along with a dispersant. Details of the dispersant are discussed more fully below. The pigment may be present in the dispersion at a level of about 5% to 20% by weight, including all values and increments therein. For example, the pigment may be present in the dispersion at a level of about 10% to about 15% by weight. The dispersion of pigment may contain particles at a size of about 50-500 nanometers, including all values and increments therein. In addition, the pigment may be further characterized as having a pigment weight percent divided by dispersant weight percent, or P/D ratio, of about 1:1 to about 8:1. For example, the P/D ratio may be about 2:1 to about 4:1, wherein the ratio integer itself may be understood to vary +/−0.20 units.

A dispersion of release agent may then be prepared in water, along with a dispersant, which dispersant is again discussed in more detail below. The release agent herein may therefore be understood as any compound that may facilitate release of toner from a component in an electrophotographic printer (e.g. release from a roller surface). Exemplary release agents contemplated herein may therefore include polyolefin wax, ester wax, polyester wax, metal salts of fatty acids, fatty acid esters, partially saponified fatty acid esters, higher fatty acid esters, higher alcohols, paraffin wax, amide waxes and polyhydric alcohol esters.

The release agent may therefore include a relatively low molecular weight hydrocarbon based polymer (e.g. Mn≦10,000) having a melting point of less than about 140° C., including all values and increments between about 50° C. and 140° C. For example, the release agent may have a melting point of about 60° C. to about 135° C., or from about 70° C. to about 120° C., etc. The release agent may then be present in the dispersion at an amount of about 5% to about 20% by weight, including all values and increments therein. For example, the release agent may be present in the dispersion at an amount of about 10% to about 18% by weight. The dispersion of release agent may also contain particles at a size of about 50 to about 800 nanometers including all values and increments therein. In addition, the release agent dispersion may be further characterized as having a release agent weight percent divided by dispersant weight percent, or RA/D ratio, of about 1:1 to about 15:1. For example, the RA/D ratio may be about 5:1 to 10:1, wherein the ratio integer itself may be understood to vary +/−0.20 units.

The dispersants for either the colorant dispersion or release agent dispersion may be a polymeric based dispersant that includes hydrophobic (e.g. styrene) and hydrophilic (e.g. acrylic acid) repeating unit functionality. Reference to hydrophobic may therefore be understood to refer to relatively non-polar type chemical structure, wherein the structure tends to self-associate in the presence of water. Hydrophilic functionality may be understood as presenting relatively polar functionality (e.g. an anionic group) which may then tend to associate with water molecules.

Expanding upon the above, the dispersants herein may specifically be sourced from those dispersants that amount to a styrene/acrylic based polymer which also may include acid functionality, which acid group may be ionized to provide anionic carboxylate functionality (—$COO^-$). Such terpolymer may therefore have the following general structure:

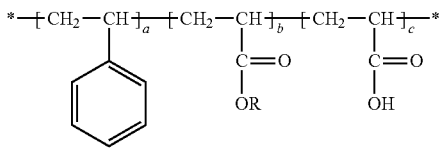

In the above structure, the values and a, b and c may be varied to provide a weight average molecular weight (Mw) of between about 5,000 to 20,000. The R group in the acrylate repeating unit may include aliphatic or aromatic type functionality. The Tg (onset of the shift in baseline (heat capacity) in a DSC analysis as noted above) may occur at about 40 to about 120° C. at a heating rate of about 5° C. per minute, including all values and increments therein. For example, the Tg may be about 40-80° C. It should therefore be noted that such Tg values of the dispersant may then allow for the use of relatively lower temperature fusers in an electrophotographic printer. In addition, the weight percent of free acid in the dispersant may be about 20% to about 50%. Suitable dispersants may therefore include dispersants such as JONCRYL 678 which is an acid functionalized styrene-acrylate resin having a molecular weight of about 5000-9000 or JONCRYL HPD 671 which is a styrene/α-methyl styrene/acrylic acid copolymer having a molecular weight of about 17,250 and an acid number of about 214.

Another suitable dispersant for use herein that includes hydrophobic and hydrophilic functionality includes anionic type dispersants that have the following general structure:

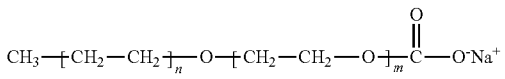

In the above, the values of n and m may again be adjusted to provide molecular weights (Mw) of about 250-5000.

The dispersant that may be employed herein also may include those dispersants disclosed and synthesized in U.S. Pat. No. 6,991,884, whose teachings are incorporated by reference. For example, such dispersants may again include a copolymer. Such dispersant copolymer may include a graft co-polymer wherein the co-polymer may contain at least two components including a hydrophilic component and a protective colloid component. These copolymers may also include more than two components, such as a hydrophobic component. These copolymers may be produced via free-radical polymerization. These polymeric dispersants may have a weight average molecular weight (Mw) from about 5,000 to about 30,000 as determined by gel permeation chromatography (GPC).

The hydrophilic component of the above referenced synthesized dispersant may again be understood as one which may associate with water, which may be due to polarity considerations. Accordingly, the hydrophilic component may again include an ionic monomer segment which may be selected from acrylic acid, methacrylic acid, crotonic acid or other carboxylic acid containing monomers. Sulfonic acid containing monomers may also be employed.

The protective colloid component includes a moiety that enables it to attach to the backbone hydrophilic segment of the polymer. Among other things, the protective colloid component may be one that enhances stability in aqueous systems and which may reduce the amount of ionic monomer component. The protective colloid may also stabilize the dispersion in lower acidic and in aqueous/alcoholic media, where a carboxylic acid group may be relatively ineffective for inducing dispersion stability. The protective colloid may also itself provide a hydrophobic functional group that may have relatively strong interaction for pigment or fuser release agent (wax).

The protective colloid may include materials such as hydroxylethylcellulose acrylate, hydroxyethylcellulose methacrylate, methoxypoly(ethyleneoxy) acrylate (containing from about 0 to about 40 moles of ethylene oxide), methoxypoly(ethyleneoxy) methacrylate (containing from about 0 to about 40 moles of ethylene oxide), methylcellulose acrylate, methylcellulose methacrylate, methylcellulose crotonate, and stearyloxypoly(ethyleneoxy) acrylate (containing 1 to about 40 moles of ethylene oxide). Mixtures of these materials may be used as well.

The protective colloid may be sourced from a reactive surfactant. Reactive surfactants may include nonylphenoxy poly(ethyleneoxy) acrylate (containing from about 1 to 40 moles of ethylene oxide), nonylphenoxy poly(ethyleneoxy) methacrylate (containing from 1 to about 40 moles of ethylene oxide), nonylphenoxy poly(ethyleneoxy) crotonate (containing from about 1 to about 40 moles of ethylene oxide), bis-nonylphenoxy poly(ethyleneoxy) fumerate (containing from about 1 to about 40 moles of ethylene oxide), phenoxypoly(ethyleneoxy) acrylate (containing from about 1 to about 40 moles of ethylene oxide), perfluoroheptoxypoly(propyloxy) acrylate, perfluoroheptoxypoly(propyloxy) methacrylate, sorbitol acrylate, sorbitol methacrylate, and allyl methoxy triethylene glycol ether.

Preferred protective colloid or reactive surfactants which may be used in the polymeric dispersants of the invention therefore may include polymers from stearyl acrylate, stearyl methacrylate, lauryl acrylate, lauryl methacrylate, nonylphenol acrylate, nonylphenol methacrylate, nonylphenoxy poly (ethyleneoxy)$_n$ methacrylate, wherein n is from 1 to about 40, including all values and increments therein, nonylphenoxy poly(ethyleneoxy)$_n$ acrylate, wherein n is from 1 to about 40, including all values and increments therein, methoxypoly (ethyleneoxy)$_n$ methacrylate, wherein n is from about 1 to about 40, including all increments and values therein, methoxypoly(ethyleneoxy)$_n$ acrylate, wherein n is from about 1 to about 40, including all values and increments therein, stearyloxypoly(ethyleneoxy)$_n$ methacrylate, wherein n may be from about 1 to about 20, stearyloxypoly(ethyleneoxy)$_n$ acrylate, wherein n may be from about 1 to about 20, including all increments and values therein, perfluoro or highly fluorinated $C_1$-$C_{18}$ alkyl methacrylate, perfluoro or highly fluorinated $C_1$-$C_{18}$ alkyl acrylate (such as trihydroperfluoro undecyl methacrylate and trihydroperfluoro undecyl acrylate), poly (propylene glycol) methyl ether methacrylate, poly(propylene glycol) methyl ether acrylate, poly(propylene glycol) 4-nonylphenol ether methacrylate, poly(propylene glycol) 4-nonylphenol ether acrylate, methacryloxy-trimethylsiloxy-terminated polyethylene oxide, and acryloxytrimethylsiloxy-terminated polyethylene oxide.

The protective colloid or reactive surfactant itself may have a molecular weight preferably ranging from about 200 to about 2,000, including all values and increments therein. The colloid or reactive surfactant segment also includes a moiety which enables it to attach to the backbone hydrophilic segment of the polymer.

As noted above, the synthetic dispersant may also include a hydrophobic backbone segment. The hydrophobic component of the dispersant may therefore include at least one electron rich functional group. Such functional group may include a polymer or copolymer containing electron rich functional groups, such as aromatic groups, including but not limited to alkyl aromatic groups and substituted aromatic groups. The functional group may include nonylphenyl, mono-, di-, and tri-styrene phenyl, polydimethylsiloxy, stearyl, and fluorinated hydrocarbon containing groups. Examples of such monomers may include, but are not limited to polymerizable monofunctional vinyl monomers from Toagosei Co. of Tokyo, Japan under the trade name ARONIX M-117, mono-methacryloxypropyl terminated polydimethylsiloxane from Gelest, Inc. of Morrisville, Pa. under the tradename MCR-M11, and polydimethylsiloxane co-polypropylene glycol methacrylate, and polydimethylsiloxane co-polypropylene glycol methacrylate. Non-siloxyl hydrophobic monomers may be derived from long chain aliphatic groups, long chain alcohols, and alkyl aryl alcohols, such as strearyl or lauryl acrylate or methacrylate or nonyl phenol acrylate or methacrylate.

The hydrophobic and protective colloid groups may also include poly(alkylene glycol) 2,4,6,-tris-(1-phenylethyl) phenyl ether methacrylate and its di and mono derivatives wherein the alkylene group may contain from 3 to 10 carbon atoms. A commercially available monomer for the hydrophobic and protective colloid groups may include poly(ethylene glycol) 2,4,6-tris-(1-phenylethyl) phenyl ether methacrylate available from Rhodia, USA of Cranbury, N.J. under the trade name SIPOMER/SEM 25. Other preferred hydrophobic groups include polydimethylsiloxane methacrylate from Gelest, Inc., polypropylene glycol nonylphenylether acrylate from Toagosei Co. under the trade name ARONIX M-117 and polydi-methylsiloxane-co-polypropylene glycol methacrylate. The hydrophobic monomer may have a molecular weight of from about 200 to about 5,000, including all values and increments therein.

The molar ratio of the hydrophilic group to the hydrophobic groups and protective colloid groups may range from about 20:1:1 to about 5:10:1.

The dispersants herein may be initially represented by the following formula:

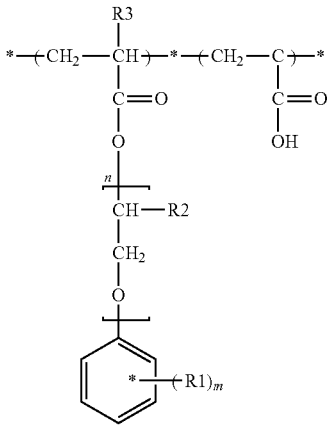

wherein n is an integer from 0 to 20, m is an integer from 1 to 3 and each R1 is independently selected from $C_1$-$C_9$ alkyl, or aryl-$C_1$-$C_9$ alkyl, provided that at least one of said R1 is aryl-$C_1$-$C_9$ alkyl and each R2 and R3 is independently selected from H and —$CH_3$. In the foregoing formula, the acrylic acid moiety may be polymerized to provide the backbone of the wax dispersant. The pendant chains of the polymer may include at least one hydrophobic segment and at least one protective colloid or reactive surfactant segment as described above. It should be appreciated however, that the alkyl group of the methacrylate ester may be replaced with other functional groups such as (ethylene glycol) 2,4,6-tris-(1-phenylethyl)phenyl.

As noted above, the synthetic dispersant may also include a hydrophobic segment that may comprise a polymer or copolymer containing electron rich functional groups. Accordingly, the dispersant may be comprised of a plurality of methacrylate derivative monomers, including a substituted methacrylate ester monomer wherein an alkoxyl group on the methacrylate ester may be replaced with a siloxyl substituent, which may be represented by the following formula:

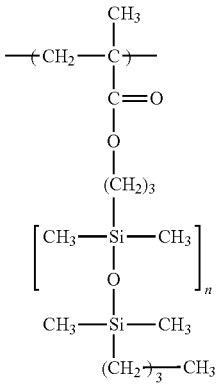

wherein n ranges from 1 to 20.

As therefore should be clear from the above, the synthetic dispersant herein may include random repeat units derived from a hydrophilic segment such as:

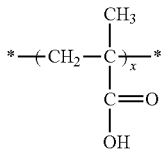

wherein x ranges from about 4 to about 20, including all increments and values therein and a segment such as:

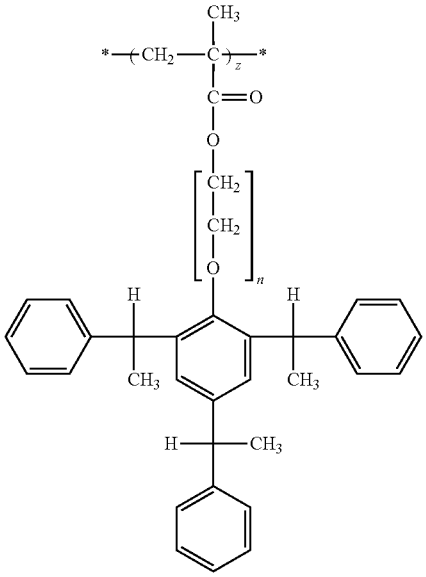

wherein z ranges from about 1 to about 5 including all increments and values therein and n ranges from about 1 to about 30, including all values and increments therein; and a segment such as:

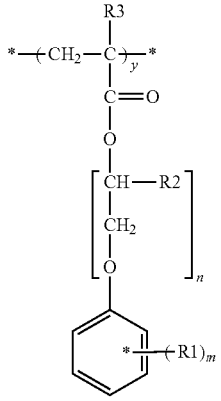

wherein y is an integer from about 1 to about 10, including all increments and values therein, n is an integer from about 1 to about 20 including all increments and values therein, m is an integer from about 1 to about 3 including all increments and values therein and each R1 may be independently selected from $C_1$-$C_9$-alkyl, or aryl-$C_1$-$C_9$-alkyl, provided that at least one of said R1 is aryl-$C_1$-$C_9$-alkyl, and each R2 and R3 may be independently selected from H and —$CH_3$.

The polymeric dispersant may be formed from corresponding monomers via free radial polymerization and may use initiators and chain transfer agents to control the polymer molecular weight and terminate the reaction. Exemplary free radical initiators may include the azo-type and peroxide-type initiators such as dimethyl 2,2'-azobisisobutyrate (V-601) from Waco Chemical & Supply Co. and 2,2'-azobisisobutyrylnitrile (AIBN) available from E.I. DuPont of Wilmington, Del. under the trade name VAZO 64. Exemplary chain transfer agents may include $C_1$-$C_{20}$ alkylthiol groups, such as n-$C_{12}$ thiol. In addition, the chain transfer agents may include phenylalkyl mercaptans or 3-mercapto-1,2 propanediol.

Examples

Synthesized Dispersant

A solution was prepared of 80.0 grams of SIPOMER SEM-25 (containing 60% active ingredient, 20% acid and 20% water), 12.6 grams of ARONIX M-117, 6.4 grams of 1-dodceanethiol, 23.6 grams of methacrylic acid and 0.3 grams of dimethyl 2,2'-azobisisobutyrate (V-601) in 75 grams of isopropyl alcohol in a flask equipped with a mechanical stirrer, condenser and thermometer. The chemicals were mixed together and degassed with nitrogen (by repeated partial evacuation followed by backfilling). The flask was then backfilled with nitrogen and immersed in an oil bath and heated to about 78° C. with stirring for about 18 hours. The product was then dried in an oven at about 80° C. The molecular weight was determined by GPC methods. The Mw was about 7200 and the Mn was about 5000. The resulting product was then dissolved in deionized water with heating. The temperature was controlled to remain below about 50° C. and the pH was adjusted to about 7.8 by the dropwise addition of 20% KOH to the solution.

Pigment Dispersion

An exemplary pigment dispersion may be prepared as follows. About 20 grams of synthesized dispersant was combined with about 900 grams of deionized water. As noted above, one may also utilize a non-synthetic dispersant, such as Akepo RLM0100. The dispersant and water are mixed with an electrical stirrer followed by the relatively slow addition of 100 grams of PR122 magenta pigment. One may also utilize PR184 pigment. When the pigment is completely wetted and dispersed the mixtures is then added to a microfluidizer (apparatus to reduce particle size). The solution is then run in the microfluidizer until the particle size is about 200 nanometers while the solution is cooled by the continuous addition of relatively cold water. The final pigment dispersion is set to contain about 10-15% solids by weight.

Release Agent Dispersion

An exemplary release agent dispersion (e.g. a wax dispersion) may be prepared as follows. About 26 grams of solid synthesized dispersant was combined with about 500 grams of water. This mixture is then run through the microfluidizer until the temperature reaches about 90° C. This is then followed by the relatively slow addition of 52 grams of POLYWAX 500 while maintaining the temperature at about 90° C. for about 15 minutes (i.e. 85° C.-95° C.). The particle size is recorded every 5 minutes after about 15 minutes and the emulsion is removed from the microfluidizer when the particle size is below 300 nanometers. The solution is then stirred at room temperature. The wax emulsion is set to contain about 10-18% solids by weight. In addition, one may follow this same general method using AKYPO RLM-100 as the dispersant wherein the wax weight ratio to dispersant weight ratio is about 11:1. One may also follow this same general method utilizing JONCRYL 67 wherein the wax weight ratio to dispersant weight ratio is about 2:1.

Emulsion Aggregation Polyester Toner Preparation

Polyester (NE701 from Kao Corporation, Japan), 100 grams, is dissolved in 300 grams of methyl ethyl ketone (MEK). After the resin is dissolved, the solution is mixed on the TEKMAR stirring apparatus at speed number 1 while adding 300 grams of deionized water and 16 grams of 5% KOH. The solution is stirred for an additional 5 minutes and the MEK is removed with a rotary evaporator with vacuum. The solution is then allowed to cool to room temperature. A microfluidizer may be used to adjust the polyester particle size. The particle size of the polyester in the emulsion is about 100-200 nm.

Toner Example 1

The following components were combined with a high shear mixer to promote relatively even dispersion: 100 grams of the NE701 polyester emulsion as prepared above, 10 grams of PR122 magenta pigment supplied from a pigment dispersion having a P/D ratio of 5:1, 7.5 grams of wax from a wax dispersion having a weight percent wax to weight percent dispersant of 3:1, and 7.0 grams of polystyrenesulfonic acid-co-maleic acid sodium salt and 5.0 grams of synthesized dispersant. About 175 grams of 1.5% nitric acid was added to the mixture to promote aggregation and the Tekmar mixing speed was turned up to remove any clumps. The agglomerate was poured into a reaction flask and 100 grams of water was used to rinse the beaker and Tekmar shaft. The particle size may be tracked as the temperature of the agglomerate is increased. When the particle size reached about 5.0 microns, about 0.9 grams of NaOH was added to stop the growth. The temperature was raised again and the circularity of the particles may be checked with a SYSMEX particle analyzer. When a desired circularity is achieved the heat is removed and the toner is then cooled to room temperature. The SYSMEX particle analyzer then indicated a mean diameter of about 5.5 microns with an average circularity of 0.95 with 10.4% of the particles by number having a diameter of less than 3.0 microns.

Toner Example 2

An emulsion containing 150 grams NE2141 (made as described above) is mixed with the pigment dispersion containing 14.0 grams pigment (75% PR122, 25% PR184) dispersed with AKYPO-RLM-100 and a wax dispersion containing 11.0 grams of EH3-13C wax (from Clairant Inc.) and 1.0 grams of JONCRYL 678 (from BASF Resins). This was followed by addition of 300 grams of 2.0% nitric acid with 2.5 grams zinc sulfate in 500 grams DI water and the Tekmar speed was turned up to break up any clumps that had formed. The agglomerate was poured into a reaction flask and 100 grams of water was used to rinse the beaker and the Tekmar shaft. The particle size was tracked as the temperature of the agglomerate was increased. At this point 6.0% NaOH was added to control the growth of the particles to the desired particle size. The temperature was held at 70° C. for 3 hours. Then the mixture was cooled and poured into the Parr Pressure reactor. The temperature in the Parr was raised to 105° C. for 5.0 minutes then cooled to room temperature. The circularity of the particles was checked with SYSMEX particle analyzer. The SYSMEX analyzer showed a mean diameter of 5.5 microns with an average circularity of 0.94 and 12.0% of the particles by number having a diameter of less than 3.0 microns.

Toner Example 3

An emulsion containing 150 grams of NE2141 (made as described above) is mixed with the pigment dispersion containing 14.0 grams pigment (75% PR122, 25% PR184, dispersed with AKYPO-RLM-100) and a wax dispersion containing 11.0 grams of EH3-13C wax (from Clairant Inc.) and 1.0 gram of JONCRYL ECO 684 (from BASF Resins). This may be followed by addition of 300 grams of 2% nitric acid with 2.5 grams zinc sulfate in 500 g DI water which was added to the mixture and the Tekmar speed was turned up to break up any clumps that had formed. The agglomerate was poured into a reaction flask and 100 grams of water was used to rinse the beaker and the Tekmar shaft. The particle size was tracked as the temperature of the agglomerate was increased. Then, 6% NaOH was added to control the growth of the particles to the desired particle size. The temperature was held at 70° C. for 3 hours. The temperature was then raised to 90° C. for 15 min and then cooled to room temperature. The circularity of the particles was checked with a SYSMEX particle analyzer. The SYSMEX analyzer showed a mean diameter of 6.1 microns with an average circularity of 0.95 and 3.0% of the particles by number having a diameter of less than 3.0 microns.

Toner Example 4

An emulsion containing 100 grams of NE2141 and 50 grams STPL1 (made as described above) is mixed with the pigment dispersion containing 14 grams pigment PR122, with the weight percent pigment to weight percent of dispersant or P/D ratio of 3.5:1) along with a wax dispersion containing 11 grams of PW500 wax with AKYPO RLM-100, wherein the weight percent wax to weight percent of dispersant is 11:1. Then, 6.0 grams polystyrenesulfonicacid-co-maleic acid sodium salt is added. This is followed by addition of 300 grams of 2% nitric acid with 2.5 g zinc sulfate in 500 grams DI water and the Tekmar speed was turned up to break up any clumps that had formed. The agglomerate was poured into a reaction flask and 100 grams of water was used to rinse the beaker and the Tekmar shaft. The particle size was tracked as the temperature of the agglomerate was increased. Then, 6% NaOH was added to control the growth of the particles to the desired particle size. The temperature was held at 70° C. for 3 hours. Then the mixture was cooled and poured into the Parr Pressure reactor. The temperature in the Parr was raised to 115° C. for 5 minutes then cooled to room temperature. The circularity of the particles was checked with a SYSMEX particle analyzer. The SYSMEX analyzer showed a mean diameter of 5.5 microns with an average circularity of 0.95 and 8.0% of the particles by number having a diameter of less than 3.0 microns.

The foregoing description of several methods and an embodiment of the invention has been presented for purposes of illustration. It is not intended to be exhaustive or to limit the invention to the precise steps and/or forms disclosed, and obviously many modifications and variations are possible in light of the above teaching. It is intended that the scope of the invention be defined by the claims appended hereto.

What is claimed is:

1. A method of forming a chemically processed toner comprising:

forming a polyester dispersion including a polyester having an acid value of about 5 to about 50 and a particle size of about 50 to about 500 nanometers by combining the polyester in an organic solvent that is miscible with water and introducing water and removing substantially all of said organic solvent wherein said dispersion has a pH of about 6 to about 8;

forming a pigment dispersion including a pigment in the presence of a dispersant wherein said dispersant contains a hydrophilic component and a hydrophobic component wherein the weight percent of pigment (P) divided by the weight percent of dispersant (D) provides a ratio P/D equal to about 1:1 to about 8:1 and wherein said pigment has a particle size of about 50 to about 500 nanometers;

forming a release agent dispersion including a release agent in the presence of a dispersant wherein said dispersant contains a hydrophilic component and a hydrophobic component wherein the weight percent of release agent (RA) divided by the weight percent of dispersant (D) provides a ratio RA/D equal to about 1:1 to about 15:1 and wherein said release agent has a particle size of about 50 to about 800 nanometers; and combining said polyester dispersion, said pigment dispersion and said release agent dispersion and agglomerating in the presence of agglomerating agent, heating and recovering agglomerated toner particles wherein said toner particles have mean particle size of about 3 to about 15 microns and an average degree of circularity of between about 0.90 to about 1.0.

2. The method of claim 1 wherein said polyester has a particle size of about 50 to about 250 nanometers and an acid value of about 10 to about 40.

3. The method of claim 1 wherein said polyester indicates the onset of a glass transition temperature (Tg) at a heating rate of about 5° C./minute in a differential scanning calorimeter of about 40 to about 80° C.

4. The method of claim 1 wherein said polyester have a peak MW as determined by gel permeation chromatography (Mp) of about 2,500 to about 40,000 and a molecular weight distribution of about 2 to about 30.

5. The method of claim 1 wherein the polyester has the following formula:

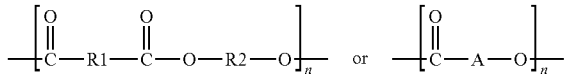

wherein R1 and/or R2 and A may be an aliphatic, aliphatic-aromatic or wholly aromatic group and n may have a value the provides a Mp value of about 2,500 to about 40,000.

6. The method of claim 1 wherein said polyester comprises a co-polyester having the following random repeating unit structures:

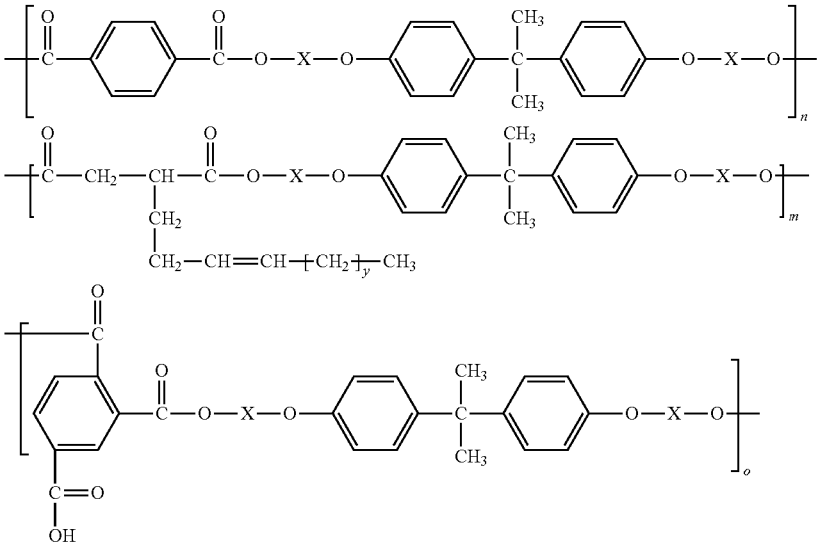

wherein n, m and o are integers which provide a Mp value of about 2,500 to about 40,000, X is an aliphatic moiety and y is an integer having a value of 1 to 20.

7. The method of claim 1 wherein said pigment and/or release agent dispersant comprises a copolymer including a hydrophilic component and a hydrophobic component.

8. The method of claim 7 wherein said pigment and/or release agent dispersant comprises a terpolymer having the following formula:

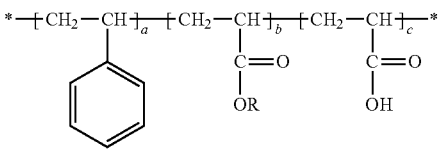

wherein a, b and c are integers may be varied to provide a Mw of about 1,000 to about 20,000.

9. The method of claim 7 wherein said dispersant has a weight average molecular weight (Mw) of about 1,000 to about 20,000.

10. The method of claim 7 wherein said pigment and/or release agent dispersant comprises a terpolymer having the following formula:

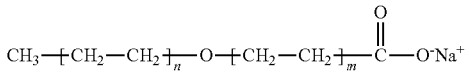

wherein the values of n and m are adjusted to provide a weight average molecular weight (Mw) of about 250 to about 5000.

11. The method of claim 1 wherein said solvent is selected from the group consisting of alcohols, ketones, amide solvents, cyclic ether solvents, ethyl acetate, sulfone solvents, and mixtures thereof.

12. The method of claim 1 wherein said pigment and/or release agent dispersant comprises a copolymer including a hydrophilic component and a protective colloid component.

13. The method of claim 1 wherein said pigment and/or release agent dispersant comprises a terpolymer including a hydrophilic component, a protective colloid component, and a hydrophobic component.

14. The method of claim 1 further comprising providing said toner particles in a printer cartridge.

15. A method of forming a chemically processed toner comprising:

forming a polyester dispersion including a polyester having an acid value of about 5 to about 50, a peak MW as determined by gel permeation chromatography of about 2500 to about 40,000, a molecular weight distribution of about 2 to about 30 and a particle size of about 50 to about 500 nanometers, by combining said polyester in an organic solvent that is miscible with water and introducing water and removing substantially all of said organic solvent wherein said dispersion has a pH of about 6 to about 8;

forming a pigment dispersion including a pigment in the presence of a dispersant wherein said dispersant contains a hydrophilic component and a hydrophobic component and indicates the onset of a glass transition temperature of about 40-130° C. and wherein the weight percent of pigment (P) divided by the weight percent of dispersant (D) provides a ratio P/D equal to about 1:1 to about 5:1 and wherein said pigment has a particle size of about 50 to about 500 nanometers;

forming a release agent dispersion including a release agent in the presence of a dispersant wherein said dispersant contains a hydrophilic component and a hydrophobic component and indicates the onset of a glass transition temperature of about 40 to about 130° C. wherein the weight percent of release agent (RA) divided by the weight percent of dispersant (D) provides a ratio RA/D equal to about 1:1 to about 15:1 and wherein said release agent has a particle size of about 50 to about 800 nanometers; and combining said polyester dispersion, said pigment dispersion and said release agent dispersion and agglomerating in the presence of agglomerating agent, heating and recovering agglomerated toner particles wherein said toner particles have mean particle size of about 3 to about 15 microns and an average degree of circularity of between about 0.90 to about 1.0.

16. The method of claim 15 wherein said polyester has a particle size of about 50 to about 250 nanometers and an acid value of about 10 to about 40.

17. The method of claim 15 further comprising providing said toner particles in a printer cartridge.

18. A method of forming a chemically processed toner comprising:

forming a polyester dispersion including a polyester having an acid value of about 5 to about 50, a peak MW as determined by gel permeation chromatography of about 2500 to about 40,000, a molecular weight distribution of about 2 to about 30 and a particle size of about 50 to about 500 nanometers, by combining said polyester in an organic solvent that is miscible with water and introducing water and removing substantially all of said organic solvent wherein said dispersion has a pH of about 6 to about 8;

forming a pigment dispersion including a pigment in the presence of a dispersant wherein said dispersant contains a hydrophilic component and a hydrophobic component wherein the weight percent of pigment (P) divided by the weight percent of dispersant (D) provides a ratio P/D equal to about 1:1 to about 8:1 and wherein said pigment has a particle size of about 50 to about 500 nanometers;

forming a release agent dispersion including a release agent in the presence of a dispersant wherein said dispersant contains a hydrophilic component and a hydrophobic component wherein the weight percent of release agent (RA) divided by the weight percent of dispersant (D) provides a ratio RA/D equal to about 1:1 to about 15:1 and wherein said release agent has a particle size of about 50 to about 800 nanometers; and combining said polyester dispersion, said pigment dispersion and said release agent dispersion and agglomerating in the presence of agglomerating agent, heating and recovering agglomerated toner particles wherein said toner particles have mean particle size of about 1 to about 10 microns and an average degree of circularity of greater than about 0.93.

19. The method of claim 18 wherein said polyester has a particle size of about 50 to about 250 nanometers and an acid value of about 10 to about 40.

20. The method of claim 18 further comprising providing said toner particles in a printer cartridge.

* * * * *